US008172005B2

(12) United States Patent
Kansola

(10) Patent No.: US 8,172,005 B2
(45) Date of Patent: May 8, 2012

(54) CEMENT SILO STRUCTURE FOR MINING MACHINE

(75) Inventor: Martti Kansola, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 305 days.

(21) Appl. No.: 12/513,184

(22) PCT Filed: Nov. 1, 2007

(86) PCT No.: PCT/FI2007/050589

§ 371 (c)(1), (2), (4) Date: May 1, 2009

(87) PCT Pub. No.: WO2008/053081

PCT Pub. Date: May 8, 2008

(65) Prior Publication Data

US 2010/0074044 A1 Mar. 25, 2010

(30) Foreign Application Priority Data

Nov. 2, 2006 (FI) ..... 20065693

(51) Int. Cl.
*E21D 20/02* (2006.01)

(52) U.S. Cl. ..... 173/184; 366/38; 366/41; 405/259.1

(58) Field of Classification Search ..... 366/38, 366/41; 173/184; 405/259.1
See application file for complete search history.

(56) References Cited

U.S. PATENT DOCUMENTS

| | | | | |
|---|---|---|---|---|
| 2,958,514 | A * | 11/1960 | Lee | 175/122 |
| 3,547,412 | A * | 12/1970 | Neustadt et al. | 366/6 |
| 5,165,825 | A * | 11/1992 | Wallin | 405/303 |
| 5,980,446 | A * | 11/1999 | Loomis et al. | 588/250 |
| 6,863,476 | B2 * | 3/2005 | Malkoski | 405/302.2 |
| 2002/0034120 | A1 * | 3/2002 | Guntert et al. | 366/2 |
| 2004/0184346 | A1 * | 9/2004 | Fisher | 366/8 |

FOREIGN PATENT DOCUMENTS

| | | |
|---|---|---|
| DE | 75 35 592 | 4/1976 |
| EP | 0 958 906 | 11/1999 |
| SE | 370 750 | 10/1974 |

* cited by examiner

*Primary Examiner* — David Sorkin
(74) *Attorney, Agent, or Firm* — Morgan, Lewis & Bockius LLP

(57) ABSTRACT

The invention relates to a cement silo structure for a mining machine comprising a mixer, a cement silo for cement and a feed apparatus for feeding cement to the mixer. The cement silo is a separate unit that may be transferred by means of transfer means between a use position on top of the mining machine and a filling position that differs from the use position.

11 Claims, 3 Drawing Sheets

CEMENT SILO STRUCTURE FOR MINING MACHINE

CROSS REFERENCE TO RELATED APPLICATIONS

This application is a National Stage Application of International Application No. PCT/FI2007/050589 filed Nov. 1, 2007, and claims benefit of Finnish Application No. 20065693 filed Nov. 2, 2006.

BACKGROUND OF THE INVENTION

The invention relates to a cement silo structure for a mining machine, which mining machine comprises a mixer, a cement silo for cement and a feed apparatus for feeding cement from a lower end of the cement silo to the mixer.

In mining there are used grouting apparatuses both for grouting bolts in holes drilled for them and for injecting cement in holes or various fragmented rocks. The required cement is fed from a specific cement silo, which is located on top of the mining machine, to a mixer below by means of a separate feed apparatus, such as a feed screw, mounted on the lower part of the cement silo, in which mixer the cement is mixed with water to produce grouting concrete. Because the cement silo is locating on top of the mining machine, it is relatively high up and charging cement into the feed silo is hard and complicated without the assistance of a separate charging hopper. This requires a separate working platform which is reached by a ladder and onto which cement sacks need to be lifted, usually by manpower, in order for them to be lifted on the brim of the cement silo and emptied therein.

BRIEF DESCRIPTION OF THE INVENTION

The object of the present invention is to provide a cement silo structure that makes the charging and using of the silo simpler and easier than the current solutions.

The cement silo structure of the invention is characterized in that the cement silo is a separate unit and that the mining machine is provided with transfer means by which the cement silo may be moved between a use position on top of the mining machine and a filling position differing from the use position.

The basic idea of the invention is that the cement silo is a separate cassette/box-type unit that is transferred for filling from the use position on top of the mining machine to another position that differs from the use position and is optionally at a lower level than the use position, i.e. to a filling position close to the ground level or even as low down as the ground level. In that case the cement silo is sufficiently high up on top of the mining machine for feeding cement into a mixer and, on the other hand, it is easy and simple to fill an empty cement silo or to replace it by a full cement silo. According to an embodiment of the invention the cement silo is a separate cassette/box that is brought filled with cement to the mining machine and lifted with transfer means on top of the mining machine, and when the box is empty it is lowered to the ground again and a new cement silo filled with cement in advance is picked. According to a second embodiment of the invention each cement silo is provided with a specific transfer screw whose rotation motor is coupled to the control system of the mining machine as a new silo is picked. According to yet another embodiment, the feed screw is fixedly mounted on the mining machine and the cement silo is merely a container filled with cement, at the bottom of which there is an orifice that can be opened and closed, and the cement silo is lifted to a position on top of the feed screw and the orifice is opened to let the cement fall onto the feed screw.

In this patent application, both in the specification and in the claims, the use position refers to a position in which cement may be fed from the cement silo into a mixer. Correspondingly, in this patent application, both in the specification and in the claims, the filling position refers to a position in which cement may be fed into the cement silo or the cement silo may be detached from transfer means and be replaced by another cement silo filled with cement.

BRIEF DESCRIPTION OF THE DRAWINGS

In the following the invention will be described in greater detail in connection with the attached drawings, in which.

DETAILED DESCRIPTION OF SOME EMBODIMENTS OF THE INVENTION

Figure 1:
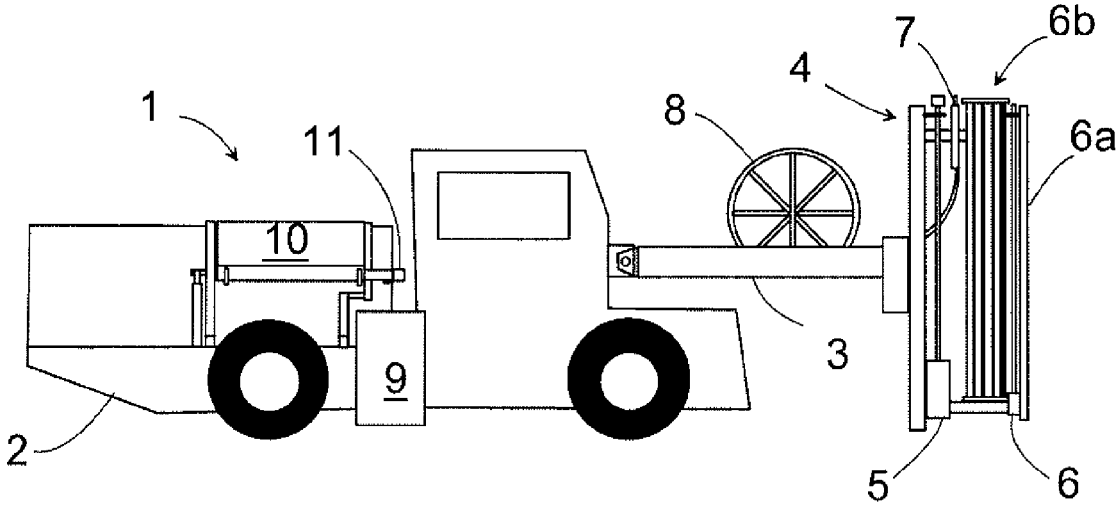
FIG. 1 shows schematically a mining machine which comprises a cement silo structure of the invention.

FIG. 1 shows schematically a mining machine 1, which in this case is a bolting apparatus, by way of example. It comprises a carrier 2, to which a boom 3 is secured at a first end. At a second end of the boom 3 there is mounted a bolting unit 4 in a rotatable manner known per se, which bolting unit comprises, as known per se, a rock drilling machine 5 moving on a feed beam 5*a*, as known per se, a bolt supply device 6 moving on a feed beam 6*a*, as known per se, a bolt magazine 6*b* and a feed hose 7 of grouting material. The hose 7 is mounted on a hose reel 8, wherefrom a necessary amount of it may be supplied into a hole so as to feed grouting material into the hole prior to inserting a rock bolt therein.

On the carrier 1 there is also mounted a mixer 9, wherewith the cement fed from a cement silo 10 is mixed with water to produce a desired mass, so that it can be supplied through the feed hose 7.

Typically, the mixer 9 is a device that is fixedly mounted at a given height and comprising a container and therein a mixer driven by a separate mixer motor. To the container there is also connected a feed pump, not shown, that pumps produced grouting material into the feed hose 7. The mixer of this kind is known per se and the structure and operation of the mixer and the relating parts are apparent to a person skilled in the art. Because that is not relevant to the invention, it is not necessary to describe it in any greater detail herein.

To simplify and facilitate the use of the mixer it is possible, of course, to mount the mixer to be vertically movable with suitable power means, such as a hydraulic cylinder, so that during operation it may be lowered down, even to the ground level, and as the mining machine moves it may be lifted sufficiently high up not to get damaged because of uneven ground or rock. In addition, the path of the cement silo may be such that while being lowered the cement silo moves outwardly from the carrier of the mining machine, whereby working will be easier, and while being lifted the cement silo moves closer to the carrier of the mining machine, whereby it is laterally more compact and thus facilitates the movement of the mining machine.

The cement silo 10, provided with a cover that will be described later in connection with FIGS. 2 to 4*b*, comprises a feed apparatus, typically a feed screw 11, by means of which cement is transferred from the cement silo 10 to be above the mixer 9 so that it will fall into the mixer 9. The feed screws 11 and the structure and operation thereof are commonly known per se, and therefore it is not necessary to describe them in any greater detail herein, apart from the features that relate to the invention.

Figure 2A:
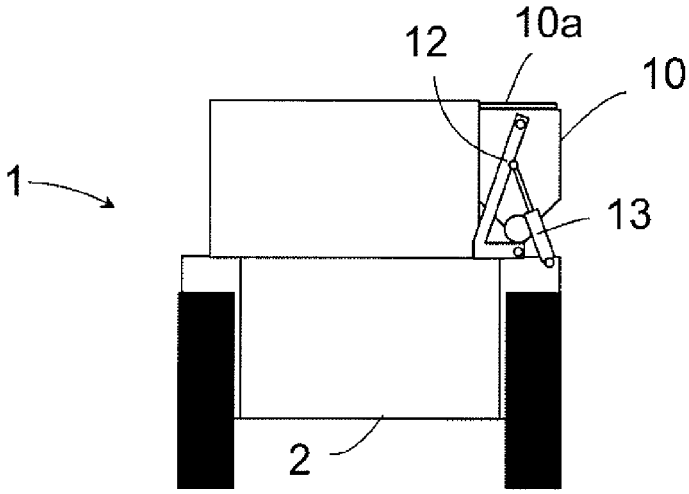
FIGS. 2*a* and 2*b* show the mining machine of FIG. 1 from behind with the cement silo in a use position and correspondingly in a filling position.
Figure 2B:
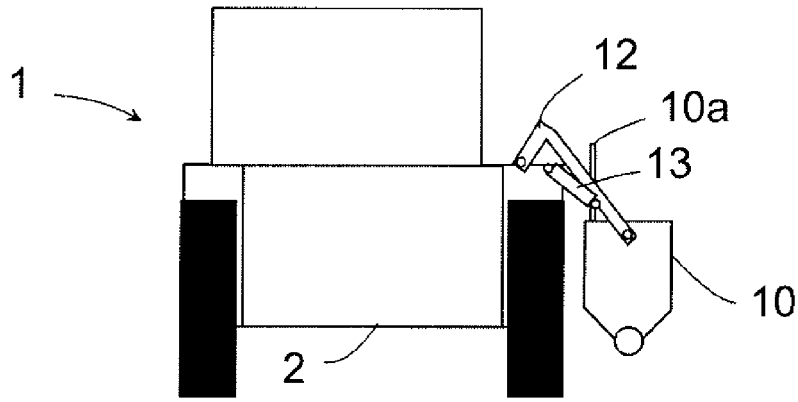

FIGS. 2*a* and 2*b* are rear views of the mining machine of FIG. 1, the cement silo 10 in the use position and in the filling position, respectively.

The cement silo 10 comprises a cover 10*a* that covers a cement feed orifice of the cement silo at all other times except when cement is fed into the silo. The cover may be mounted in relation to the cement silo and the transfer means such that it opens automatically as the cement silo 10 is lowered down. On the other hand, in some situations, for instance when the mining machine is serviced, there must be a possibility for the cover to remain over the cement silo 10, whereby the cement silo may be used as a working platform and a step while the motor behind the cement silo and the rest of the equipment are being serviced. Further, when necessary, there may be provided a separate lifting equipment or another mechanism for the cover 10*a*.

FIG. 2*b* shows the cement silo lowered by means of lifting arms 12 and a lifting cylinder 13 comprised by the transfer means sufficiently down beside the mining machine so that the filling of the silo becomes easy. The cement silo 10 may also be lowered to rest on the ground or rock below. When necessary, the cement silo 10 may be detached from the lifting arms 12 by using a simple latch locking or the like. Alternatively, fasteners at the ends or edges of the cement silo may have a form to allow detachment from the lifting arms as the lifting arms 12 are lowered sufficiently down while the cement silo 10 rests on the ground or rock. The cement silo may then be left on said spot and another cement silo may be picked by moving the mining machine in the longitudinal direction to reach a new cement silo and by lifting the lifting arms at that point to lock to supports of the new cement silo.

Figure 3B:
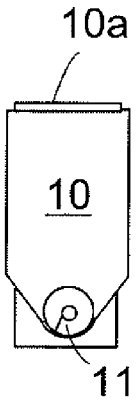
FIGS. 3*a* and 3*b* are schematic side views of a cement silo of the invention, seen cut along line A-A.
Figure 3A:
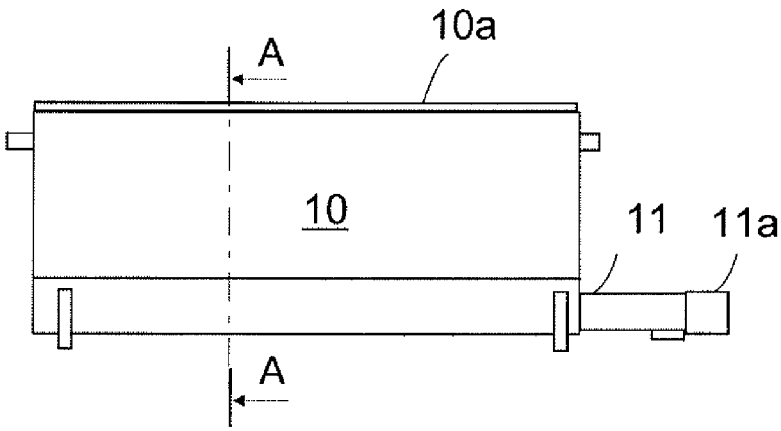

FIGS. 3*a* and 3*b* are schematic side views of an embodiment of the invention, seen cut along line A-A. In this embodiment a feed screw 11 is mounted fixedly on the lower part of the cement silo 10, and when the cement silo replacement method is used, each cement silo comprises a specific feed screw. The rotation motor 11 a of the feed screw is, for instance, a hydraulic motor that is coupled with hoses to the control system of the mining machine to be controlled by its control devices.

Figure 4B:
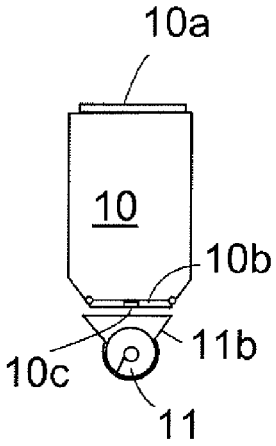
FIGS. 4*a* and 4*b* are schematic side views of a second cement silo of the invention, seen cut along line B-B, respectively.
Figure 4A:
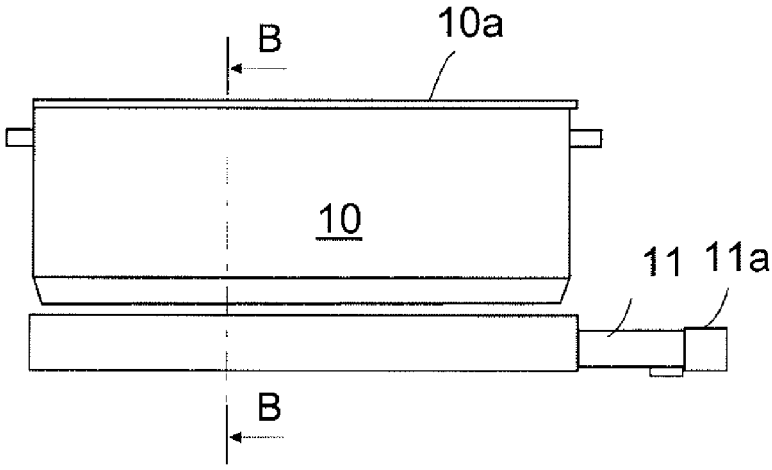

FIGS. 4*a* and 4*b*, in turn, are side views of a second embodiment, seen cut along line B-B. Here the cement silo 10 is merely a box filled with cement and the feed screw 11 is fixedly mounted on top of the mining machine 1. In that case the lower end of the cement silo 10 comprises, for instance, closing flaps 10*b* that are locked to a closing position with locking means 10*c* as the cement silo is filled. The lower part of the cement silo 10 is also preferably downwardly tapering and the brim, which is above the feed screw 11 and partly shown in the figures, is widening, respectively. Consequently, when the cement silo is lifted in place, it will fit closely at the edges inside the edges 11*b* of the feed screw 11. In this situation, depending on the structure, by drawing or turning the locking means 10*c* aside from beneath the edge of the closing flaps 10*b*, the closing flaps 10*b* will turn downwardly against the cement silo walls and the cement will be able to fall onto the feed screw 11.

Figure 5:
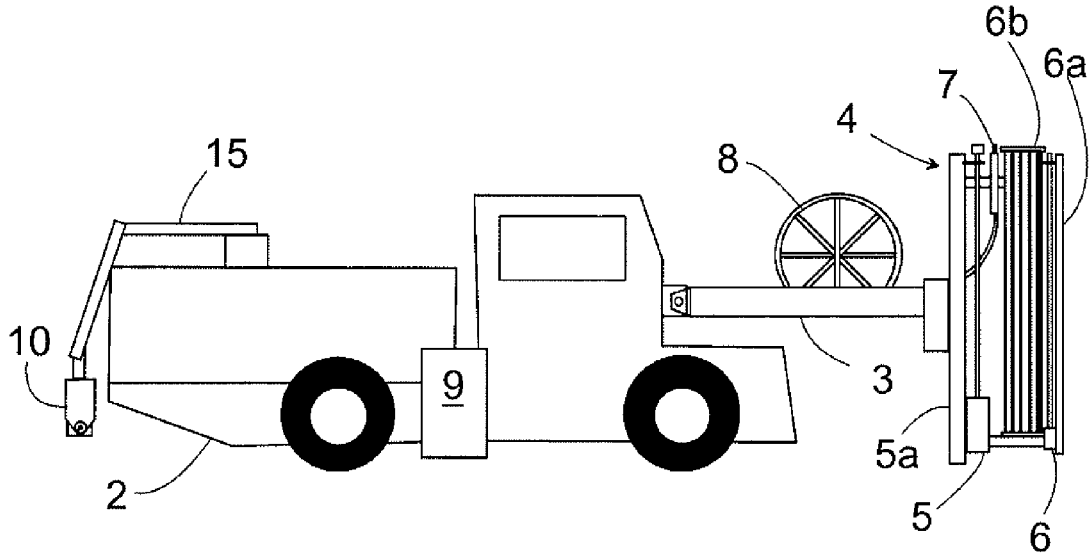
FIG. 5 shows an embodiment of the invention and FIG. 6 shows yet another embodiment of the invention.

FIG. 5 shows an embodiment of the invention, in which the filling position of the cement silo is located behind the mining machine, not beside it. In this embodiment transfer means 15 include a boom 15, which is mounted rotatably about the vertical axis in relation to the mining machine such that the cement silo 10 may be turned behind the mining machine from the use position and by turning the boom downwardly it may be lowered to the filling position. Correspondingly, by turning the boom upwardly the cement silo 10 may be lifted up from the filling position and thereafter turned to its place in the use position. One end of the boom is connectable to the cement silo in any manner known per se, most preferably so that the cement silo remains in the same position in relation to the boom 15 and thus turns about 90 degrees between the use position and the filling position.

Figure 6:
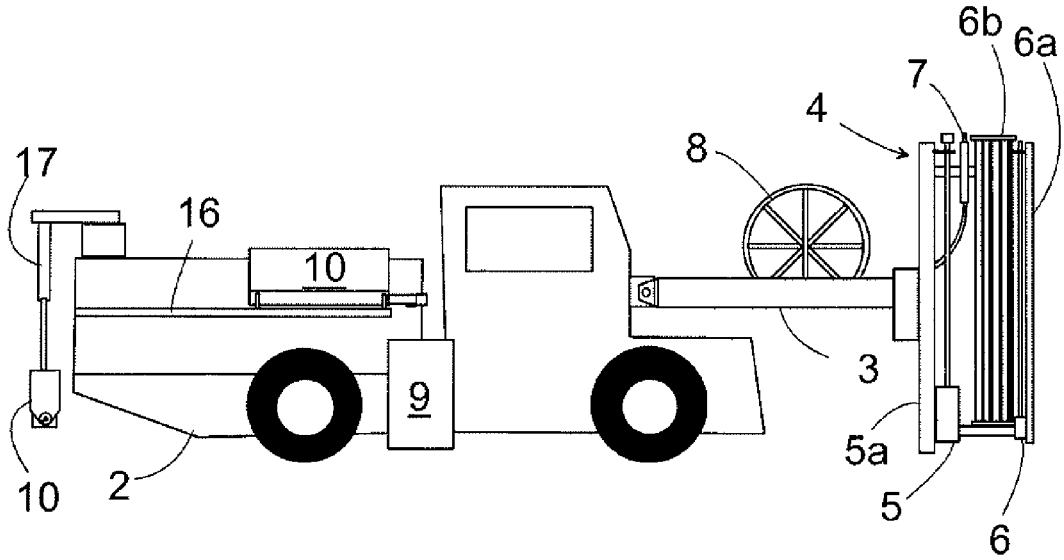

FIG. 6, in turn, shows yet another embodiment of the invention, which comprises transfer rails 16 on top of the mining machine for moving the cement silo, along which rails the cement silo 10 may be transferred in the longitudinal direction of the mining machine from the use position to a rear section of the mining machine, and correspondingly, from the rear section to the use position. In this embodiment, at the rear end of the mining machine there is also a lifting apparatus 17, whereby the cement silo may be transferred from the rails behind the mining machine and down to the filling position, and correspondingly, from the filling position onto the rails 16.

In the above specification and the relating drawings the invention is described by way of example only and it is by no means restricted thereto. The appearance of the cement silo 10 may vary depending on the mining machine and other equipment used. The location and structure of the feed screw 11 may be anything that suits the cement silo. The shape of the lifting arms 12 may vary, and when necessary, the arms may consist of interlinked multiple pieces. Instead of the lifting arms it is also possible to use various booms or the like for transferring the cement silo 10. Instead of the lifting cylinder 13 it is possible to use conventional hydraulic motors, etc., for turning the lifting arms. Instead of the feed screw it is possible to use feeding means of some other kind, such as feeding devices based on compressed air. The filling position need not necessarily be located lower than the use position. If the cement silo may be lifted off the filling position with a forklift or some such device, and correspondingly a new cement silo may be placed in the filling position, the filling position and the use position may be, for instance, at the same height or the filling position may even be higher up than the use position.

The invention claimed is:

1. A mining machine comprising a cement silo for cement, which mining machine is intended for drilling holes in a rock and injecting cement into the holes, and which mining machine further comprises:

a mixer, and a feed apparatus for feeding cement from a lower end of the cement silo to the mixer, wherein the cement silo is a separate unit and the mining machine is provided with transfer means, by means of which the cement silo may be moved between a use position on top of the mining machine and a filling position differing from the use position.

2. The mining machine of claim 1, wherein the transfer means comprises:

lifting arms, wherein one end of the lifting arms are connected to the mining machine rotatably about the longitudinal axis of the mining machine and the other end of the lifting arms are connectable to the cement silo for moving the cement silo between the use position and the filling position, and power means for turning the lifting arms between the use position and the filling position of the cement silo.

3. The mining machine of claim 1, wherein the transfer means comprises a boom, wherein a first end of the boom is mounted on the mining machine rotatably in relation to the mining machine and the second end of the boom is connectable to the cement silo for moving it between the use position and the filling position.

4. The mining machine of claim 3, wherein the filling position is located in a rear part of the mining machine.

5. The mining machine of claim 1, wherein the transfer means comprises rails on top of the mining machine, along which rails the cement silo is movable from the use position to a rear part of the mining machine, and correspondingly, from the rear part to the use position.

6. The mining machine of claim 5, wherein the filling position is located lower than the use position and the transfer means further comprises a lifting apparatus connected to the mining machine for lifting the cement silo from the filling position onto the rails at the rear part of the mining machine, and correspondingly down to the filling position.

7. The mining machine of claim 1, wherein the cement silo comprises a feed screw that is mounted in the lower part of a cement silo for feeding cement into the mixer.

8. The mining machine of claim 1, wherein the cement silo is a box separate from the feed apparatus, the feed apparatus is mounted on top of the mining machine, a lower part of the cement silo includes an orifice and a closing flap that is closable and openable, and between the cement silo and the feed apparatus there are sealing means for interconnecting the cement silo and the feed apparatus in a substantially tight manner.

9. The mining machine of claim 8, wherein the sealing means includes a lower edge of the cement silo, which is downwardly tapering, and an edge above the feed apparatus, which is upwardly widening, such that when the cement silo is set in the use position its lower edge fits inside the edge of the feed apparatus in a substantially tight manner.

10. The mining machine of claim 1, wherein the cement silo is detachable from the transfer means so that an empty cement silo may be detached and replaced by a new cement silo filled with cement.

11. The mining machine of claim 1, wherein the filling position of the cement silo is located lower down than the use position.

* * * * *